US011278912B2

(12) United States Patent
Gräber et al.

(10) Patent No.: US 11,278,912 B2
(45) Date of Patent: Mar. 22, 2022

(54) INTELLIGENT, SELF-ADAPTIVE CONTROL APPARATUS FOR THE AUTOMATED OPTIMIZATION AND CONTROL OF THE GRINDING LINE OF A ROLLER SYSTEM, AND CORRESPONDING METHOD

(71) Applicant: BÜHLER AG, Uzwil (CH)

(72) Inventors: Matthias Gräber, St. Gallen (CH); Christian Heiniger, Winterthur (CH)

(73) Assignee: BÜHLER AG, Uzwil (CH)

( * ) Notice: Subject to any disclaimer, the term of this patent is extended or adjusted under 35 U.S.C. 154(b) by 122 days.

(21) Appl. No.: 16/766,776

(22) PCT Filed: Nov. 23, 2018

(86) PCT No.: PCT/EP2018/082448
§ 371 (c)(1),
(2) Date: May 26, 2020

(87) PCT Pub. No.: WO2019/101968
PCT Pub. Date: May 31, 2019

(65) Prior Publication Data

US 2020/0368755 A1 Nov. 26, 2020

(30) Foreign Application Priority Data

Nov. 23, 2017 (EP) ..... 17203422

(51) Int. Cl.
*B02C 25/00* (2006.01)
*B02C 4/06* (2006.01)
(Continued)

(52) U.S. Cl.
CPC ..... *B02C 25/00* (2013.01); *B02C 9/04* (2013.01); *B02C 4/06* (2013.01); *B02C 4/38* (2013.01); *B02C 2210/01* (2013.01)

(58) Field of Classification Search
CPC .. B02C 25/00; B02C 4/06; B02C 4/36; B02C 4/38; B02C 4/04; B02C 4/16; B02C 4/22; B02C 4/24
See application file for complete search history.

(56) References Cited

U.S. PATENT DOCUMENTS

2013/0008985 A1* 1/2013 Held ..... B02C 17/1805 241/5
2013/0209626 A1* 8/2013 Keller ..... A23F 5/08 426/233

(Continued)

FOREIGN PATENT DOCUMENTS

DE 2413956 A1 9/1974
JP 06-114282 A 4/1994
WO 97/41956 A1 11/1997

OTHER PUBLICATIONS

International Search Report and Written Opinion dated Mar. 18, 2019 for PCT/EP2018/082448 filed on Nov. 23, 2018, 15 pages including English Translation of the International Search Report.

*Primary Examiner* — Gregory D Swiatocha
(74) *Attorney, Agent, or Firm* — Xsensus LLP

(57) ABSTRACT

A product processing installation and corresponding method for the grinding and/or crushing of granular fruits or the like. There is a self-adaptive regulation and control method and corresponding regulation and control device for the self-optimised control of a mill installation and a grinding line of a roller system of the mill installation. The grinding line include a plurality of processing units, which, based on operational process parameters, can each individually be controlled and individually regulated in their operation by means of the regulation and control device. A batch control with a defined processing sequence in the processing units can be regulated by an operational process recipe, wherein a defined amount of a final product can be produced from (Continued)

Figure 1:
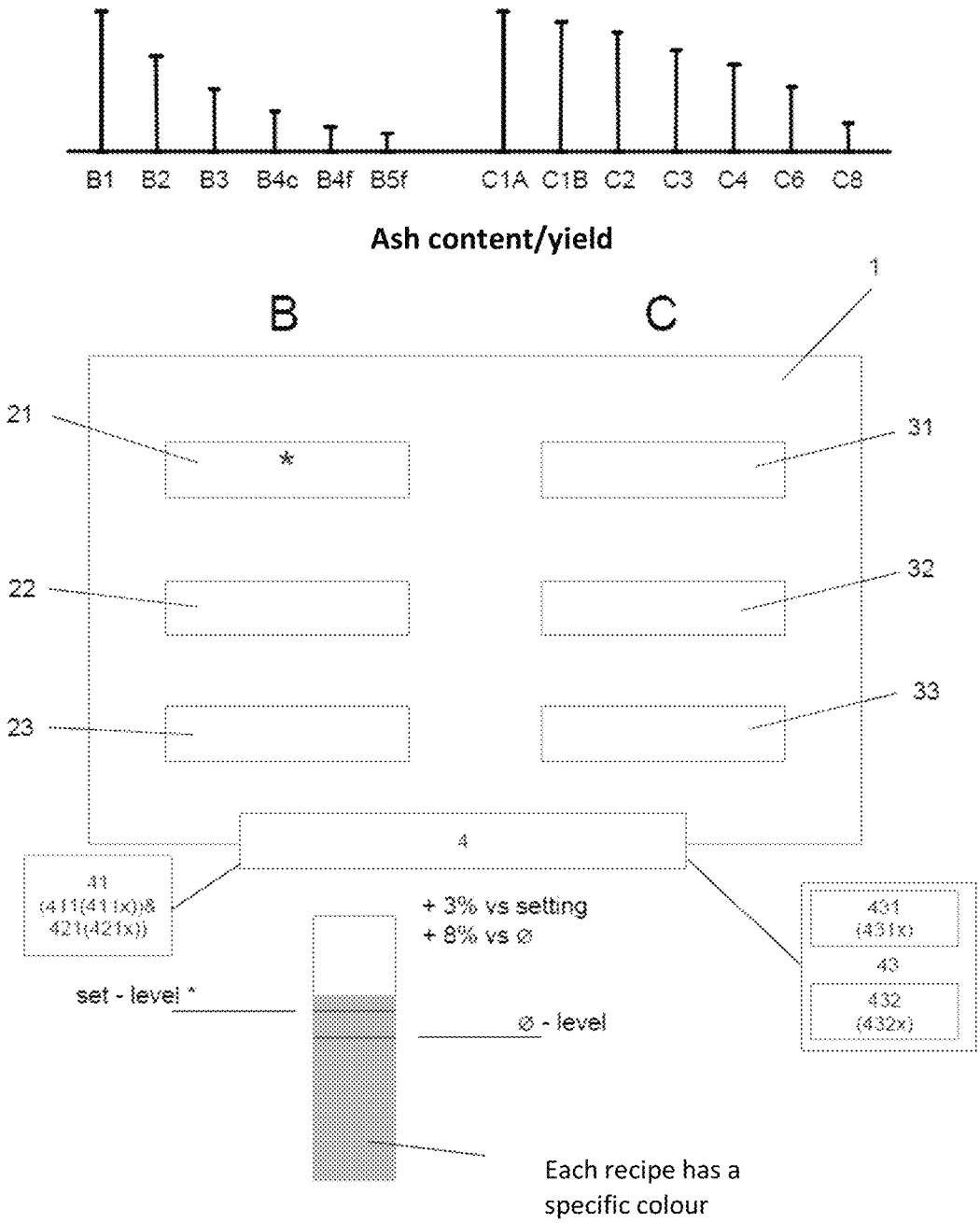

one or more input materials by means of the operational process recipe. The processing units are controlled based on specific operational batch process parameters assigned to the operational process recipe.

11 Claims, 12 Drawing Sheets

(51) Int. Cl.
*B02C 4/38* (2006.01)
*B02C 9/04* (2006.01)

(56) References Cited

U.S. PATENT DOCUMENTS

2015/0336107 A1* 11/2015 Kube ..... B02C 15/06
241/30
2021/0283618 A1* 9/2021 Matsuda ..... G06Q 10/04

* cited by examiner

INTELLIGENT, SELF-ADAPTIVE CONTROL APPARATUS FOR THE AUTOMATED OPTIMIZATION AND CONTROL OF THE GRINDING LINE OF A ROLLER SYSTEM, AND CORRESPONDING METHOD

CROSS-REFERENCE TO RELATED APPLICATIONS

The present application is based on PCT filing PCT/EP2018/082448, filed Nov. 23, 2018, which claims priority to EP 17203422.5, filed Nov. 23, 2017, the entire contents of each are incorporated herein by reference.

FIELD OF THE INVENTION

The present invention relates to an intelligent, self-adaptive regulation and control device for the automated regulation and control of grinding and roller systems, in particular mill installations with a roller mill, but also mill systems and grinding installations in general. The invention relates in particular to regulation devices for grain mills and other installations for the processing and comminution of grains, in particular installations for the comminution, transport, fractionating and conditioning of grains and to regulation and control methods and regulation devices for self-optimised control and monitoring of such installations. Possible applications of the device according to the invention also relate to the grinding and roller systems with real-time or quasi-real-time measurement and monitoring of operating parameters such as roller temperature, roller gap, roller rotational speed, roller pressing force and/or energy intake of one or various roller drives, and/or with real-time or quasi-real-time measurements of ingredients or quality parameters during the product preparation and processing in the grain milling installations for the purpose of process monitoring (measuring, monitoring) and control and/or regulation of the installations or processes, such as measurands like water content, protein content, starch damage, ash content (minerals) of flours (or grinding intermediate products), residual starch content, grinding fineness, etc. However, as mentioned above, the invention also relates generally to mill systems, for example ball mills or so-called semi-autogenously grinding mills (SAG), which are suitable for grinding coarse-grained materials such as ores or cement, etc. Even with such mills, the throughput and the product quality parameters are controlled by adjusting various setting or reference variables such as rotational speed of the mill drum, energy intake of the mill drum, supply of the (coarse) granular starting material/input materials, water supply in ore mills and/or discharge speed of the ground material present at the exit. Even with these mills, the particle size distribution of the ground material is an important quality feature. In particular, it can influence the yield of the further components downstream of the mill system, such as flotation. The highest possible throughput is achieved with high product quality and low energy consumption and material requirements, i.e. costs.

The present invention thus relates in a preferred application to roller systems, product processing installations and grinding installations containing rollers or pairs of rollers, and corresponding methods for the optimised operation of such grinding and roller systems or product processing installations. In particular, the installations mentioned relate to complete installations for (i) the grain milling plant, (ii) flour preparation for industrial bakeries, (iii) installations for speciality milling, (iv) production installations for the manufacture of high-quality feed for livestock and domestic animals, (v) special installations for the manufacture of feed for fish and crustacea, (vi) premix and concentration installations for the manufacture of active ingredient mixtures, (vii) oil production from oilseeds, (viii) treatment of extraction meals and white flakes, (ix) high-level installations for the processing of biomass and manufacture of energy pellets, (x) installations for ethanol production, (xi) complete rice process installations, (xii) sorting installations for foods, seeds and synthetic materials, (xiii) grain and soya handling, (xiv) installations for loading and unloading of ships, trucks and trains through storage to the discharge of grain, oil seeds and derivatives, (xv) silo equipment for vertical steel and concrete silos and flat storage, (xvi) mechanical and pneumatic ship unloaders and ship loaders, (xvii) conveying components, (xviii) industrial malting and crushing installations, (xix) machinery and equipment for the processing of cocoa beans, nuts and coffee beans, (xx) machines and installations for the manufacture of chocolate and fillers and coatings, (xxi) machines and installations for the moulding of chocolate items, (xxii) overall concepts for production lines for the manufacture of long goods, dry goods, noodles, lasagne. couscous and speciality pasts products, (xxiii) systems and installations for extruding (cooking and shaping) of breakfast cereals, food and feed ingredients, petfood, aquafeed and pharmaceuticals, (xxiv) installations for the manufacture of paints, varnishes and dispersions, (xxv) planning of complete solutions for wet grinding technology and production of machines and process equipment for the manufacture of printing inks, coatings and particle dispersions for the cosmetics, electronics and chemical industries, (xxvi) heat treatment of polymers (PET), (xxvii) installations for the manufacture of PET bottles, (xviii) SSP and conditioning installations for the treatment of PET and other plastics, (xxix) installations for bottle-to-bottle recycling, (xxx) manufacture of ready-to-use nanoparticle dispersions, (xxxi) turnkey processing processes for nanoparticles in the liquid phase, (xxxii) industrial solutions for drying and further thermal processes, (xxiii) isolation and characterisation of aleurone from wheat bran, rice fortification, etc.

BACKGROUND OF THE INVENTION

Milling, in particular grain milling, is also referred to as an art. Unlike in other areas of industry, in which the influence of the various factors that determine the dynamics of a process is mostly well known, and in which the relevant processes can therefore be easily parameterised using appropriate equations and formulas or the apparatus and device involved is simply controlled and regulated accordingly, the number of relevant factors that influence the grinding quality and also the yield of the processed final product is extraordinarily high in the milling industry. It is therefore often necessary for a miller, as human expert, to manually adjust and set the entire grinding or milling installation following analysis of the starting/raw material based on his intuition and know-how in order to obtain the best possible results in terms of the expected quality and yield of the final product (e.g. ash content, yield, baking quality, etc.). All this while minimising costs, i.e. in particular, energy efficiency. It should also be noted that the grinding properties of the starting material, e.g. the ground wheat or grain, are fundamental for the grinding process. Since the grinding installation must typically be regulated by the head miller, the head miller also has decisive influence on and control of the characteristics of the produced flour. This starts with the choice of the wheat class, which can refer to both the market class and to the place or region of production of the wheat, to influence certain grain attributes such as a certain protein range. The miller also controls the wheat blend/grists, which are added to the grinding installation. The miller can also measure the mill flow, roller speed, speed differentials, distribution of the fluted rollers, e.g. sharp-to-sharp, and roller pressure in the case of smooth rollers. The miller has additional regulation options in combination with sieving and cleaning and finally in the grinding current selection for mixing the final flour produced. All these parameters and regulation options are used by the miller to consistently produce a flour of a certain quality.

As shown by the example discussed, grinding rollers in particular, as used for example in grain milling, require permanent monitoring. Apart from the optimisation of the production and the characteristics of the final product, it may also happen, for example, that a so-called dry run, rocking in the regulatory control or other operational anomalies occur. If an abnormal condition lasts too long, the, for example, the temperature of the grinding roller can rise to a critical range and potentially cause a fire or damage to the roller. However, operational anomalies can affect the optimal operation of the installation in a different way, in particular the quality, yield or energy consumption. Although grinding installations are at least partially automated in many areas, current systems relating to automatic control and optimal operation are difficult to automate. In the prior art mill systems are therefore often still set manually by operating personnel according to their empirical experience. Automated control or regulation of the operation is often limited to the signal transmission and transmission of control commands, e.g. via PLC control and connected input devices with graphical user interface (GUI). PLC refers to a Programmable Logic Controller, which can be used as a device to control or regulate a machine or installation and can be programmed on a digital basis. If the quality of the supplied material changes, it typically takes a certain time before a high throughput can again be achieved with good product quality. In addition, the operator often only has an indirect quality control, which results, for example, from a drop in yield in one of the downstream components. This also complicates a good setting of the mill system or, for example, timely intervention if anomalies occur in the grinding process. If there is one operator (head miller) in the regulation and control of a grinding roller system, complete control of the entire production process is however absolutely necessary in order to be able to execute such control "by hand" at all. The result of the control is substantially dependent on the respective technical skills and experience of the operator, i.e. the supervising head miller. If less qualified personnel are used for the operation, e.g. during special times (holidays, night work, etc.), this may result in a reduction in results for the mill, for example due to a lower yield of light flour or the like. Attempts to replace the head miller with processor-based regulation devices [sic] that the complex knowledge and experience of the head miller could not be automated simply by means of rule-controlled devices, especially not by independently, self-sufficient functioning regulation set-ups that work without regular routine human intervention.

As far as the grinding and reduction systems are concerned, different grinding and reduction systems are known in the prior art. The roller mill is by far the most important grinding device for grain and grain mills. Whether it is maize, common wheat, durum wheat, rye, barley or malt that is to be processed, the roller mill usually offers the most ideal processing of all types of grain. The process used in a grain mill is a stage comminution. The flour core (endosperm) is crushed step by step by passing through a plurality of fluted or smooth pairs of steel rollers. It is separated in separators by sieves from the bran and the seedling by sieves. In the case of pairs of rollers of a roller mill, one roller typically rotates faster than the other. Due to the opposite rotation of the two rollers, the material is drawn into the roller gap. The shape, depth and swirl of the fluting together with the rotational speed differential determine the intensity of the grinding in each step. Impact mills are also known. Impact mills are suitable, for example, for grinding a wide a plurality of products in grain mills (grain and by-products of grinding), animal feed factories (animal feed, legumes), breweries (fine meal production for mash filtration), oil mills (extraction meal and crushed oil cake) or even pasta factories (pasta waste). The product is fed to the impact mill or hammer mill from a preliminary container and captured by the beater rotor. The particles are comminuted until they can pass through the openings of a sieve shell surrounding the rotor. Finally, flaking installations are also known, in which the flaking mill together with the corresponding steaming apparatus forms the core. The flaking material is treated hydrothermally in the upstream steaming apparatus before it reaches the flaking mill. The installation is suitable for processing pearl barley (whole, cleaned and peeled oat kernels) as well as groats (cut oat kernels), maize, common wheat, barley, buckwheat and rice. It should be noted that due to the specific problems and requirements in the production of flour and semolina from grains and similar products, an independent type of roller mill, the so-called milling roller mill, has developed, which, in contrast to the grinding technology of rocks, the production of flakes from vegetable raw materials, etc., contains a very unique grinding technique.

Regardless of the specific properties of the grain mills, it is known in all of the grinding systems discussed in the prior art (see, for example, DE-OS 27 30 166) that there are and can always be disruptive influences which do not allow idealised grinding conditions. These disruptive influences include, among other things, uneven roller temperatures, changing the spring characteristics of a pair of rollers, changing the grinding gap or grinding pressure, etc. The invention relates in particular to a control and regulation device for stable, adaptive control and regulation of the described grinding systems for grinding grain and influencing process elements (grinding material and installation elements) and the operational process parameters of the grain mill installation that can be assigned to these, with timely detection of disruptive influences or other operational anomalies. It is known that the provision and automation of such control and regulation systems is complex, since a plurality of at least partially interdependent, i.e. correlated, parameters must be taken into account (e.g. EP0013023B1, DE2730166A1). The operation of the grinding devices is influenced by a plurality of parameters, such as through the selection of the type of grain or the grain mixture and the growing area, the harvest time, the desired quality criteria, the specific weight and/or the moisture of the individual sorts of grain or the grain mixture proportions, the air temperature, the relative air humidity, the technical data of the installation elements used in the mill system and/or the desired flour quality as specified process variables and the selection of the distance, the grinding pressure, the temperature and/or the power intake of the motors of the grinding rollers, the flow rate and/or the moisture content of the grinding material achieved and/or the quality of the flour with respect to the mixture proportions, which complicates sufficiently differentiated control of the grinding process in the grain mill installations. It is often sufficient that a few of these process variables and operational process parameters slip outside their tolerance in order to have a massive influence on the operation of the mill. It is thanks to this complexity of the process that despite all efforts to automate the installations, the head miller is still current, since, as a "human expert", he has to decide whether a change in the control signals assigned to the input signal variables appears desirable or not. The head miller will always take the target variables into account. If he has found an optimal assignment between the input signal variables mentioned and the control signal variables, this assignment is typically ensured by corresponding memory allocation and addressing within the grain mill installation.

Prior art document WO9741956A1 discloses a method for the automated control of the grinding process in a mill with a plurality of grinding units. A sample is sieved at the exit of the grinding units. In the sample, the percentage of throughput to retained grinding material is compared to predefined standard values. If a deviation is measured, the gap between the grinding rollers of the grinding pair of rollers of the grinding unit concerned is adjusted in accordance with the deviation. DE2413956A1 of the prior art also relates to a method for grinding grain to flour using grinding units, and subsequent sieving. As is known, when grinding the grain, the grinding material is passed through a number of successive roller mills, wherein the emerging material is sieved to separate the material which has been ground to the required size, while the remaining material is fed to the subsequent grinding units disposed behind one another. The grinding units are monitored by means of a monitoring unit. The behaviour of the grinding units is controlled based on a predefined scheme during the grinding process so that it matches the predefined scheme. Finally, JPH06114282A shows a method for monitoring the particle size distribution in a grinding installation, with the aim of maintaining a constant particle size distribution within the installation. In the method, the delivery rate, the distance between the grinding rollers and the spring pressure of the rollers are monitored in order to obtain the desired particle size distribution. The method adapts the regulation of the grinding installation if a deviation of the particle size distribution from the desired particle size distribution is detected.

SUMMARY OF THE INVENTION

It is an object of the present invention to solve the disadvantages and technical problems known from the prior art. In particular, an intelligent, self-adaptive control/regulation device for the automated optimisation and control of the grinding line of a roller system is to be provided, with which the grinding and/or crushing can be optimised and automated, and which increases the operational security of a mill and at the same time optimises the operation or automatically reacts to occurring anomalies. The control/regulation device should be able to identify long-term trends in production and detect abnormalities in operation. It is intended to enable simple automated monitoring and detection of critical production parameters, in particular yield, energy and throughput/machine running time, and to allow automated adaptation of the operation with optimisation of the relevant parameters or an automated adaptation of the operation in the event of abnormalities or anomalies. Finally, the method should allow a quick, automated and stable setting of a mill system during initial setting.

According to the present invention, these objects are achieved in particular by the elements of the characterising part of the independent claims. Further advantageous embodiments also emerge from the dependent claims, the drawings and the description.

In particular, these objects are achieved by the invention for an intelligent, self-adaptive regulation and control device and/or apparatus for the self-optimised control of a mill installation and/or a grinding line of a roller system of the mill installation in that the grinding line comprises a plurality of processing units, such as fluted and/or smooth rollers and/or sieves, etc., which, based on operational process parameters, can be individually controlled by means of the regulation and control device and can be individually regulated in their operation, wherein by means of an operational process recipe a batch control can be regulated with a defined processing sequence in the processing units, wherein a defined quantity of a final product can be produced from one or more starting materials by means of the operational process recipe, and wherein the processing units are controlled based on specific operational batch process parameters assigned to the operational process recipe. The regulation and control device comprises a pattern recognition module for detecting operational process recipes with multi-dimensional batch parameter patterns, wherein an operational process recipe comprises, stored, at least one or more starting products, a defined sequence of a grinding process within the processing units of the grinding line, and operational batch process parameters assigned to the respective processing units of the grinding line. The regulation and control device comprises a storage device for storing historical operational process recipes with historical batch process parameters, wherein the historical batch process parameters of a process recipe each define a process-typical, multi-dimensional batch process parameter pattern of an optimised batch process in the standard range. When entering final product parameters and/or input product parameters of a new operational process recipe, closest batch process parameter patterns are triggered and/or selected by means of pattern recognition of the pattern recognition module of one or more of the stored historical operational process recipes based on the assigned multi-dimensional batch parameter patterns as a new batch parameter pattern. By means of the regulation and control device, based on the triggered closest batch process parameter patterns, new batch process parameter patterns with new batch process parameters for the entered new operational process recipe are generated, wherein the processing units based on the generated operational process recipes with the assigned batch process parameters are correspondingly controlled and regulated by means of the regulation and control device. During the grinding process of the new operational process recipe, the operational process parameters can be continuously monitored by means of the regulation and control device, wherein in the case of detection of an anomaly as a defined deviation of the monitored operational process parameter from the specified operational process parameters of the new operational process recipe, a warning signal is transmitted to an alarm unit. The batch process parameters can, for example, at least comprise measurement parameters relating to the currents and/or power intake of one or more roller mills of the mill installation. The one or more roller mills can, for example, comprise at least fluted rollers (B passage) and/or smooth rollers (C passage). The batch process parameters can in particular, for example, at least comprise measurement parameters relating to the currents and/or power intake of all roller mills of the mill installation. The invention has the advantage, among other things, that a technically novel, intelligent, self-adaptive control/regulation device for the automated optimisation and control of the grinding line of a roller system can be provided, with which the grinding and/or crushing can be optimised and fully automated, and which increases the operational security of a mill and at the same time optimises the operation or automatically reacts to occurring anomalies. The inventive control/regulation device is able to identify long-term trends in production and detect abnormalities in operation. It enables a novel, simple and automated monitoring and detection of critical production parameters, in particular yield, energy and throughput/machine running time, and allows an automated adaptation of the operation during operation to optimise these parameters or an automated adaptation of the operation in the event of detected abnormalities or anomalies during operation. If the inventive system and method is finally used for the initial setting, this allows a mill system to be set quickly and stably based on historical, optimised parameter sets.

In one embodiment variant, quality parameters of the final product and specific flour yield as a function of the starting products can be determined by means of the process-typical batch process parameters of an optimised batch process within the standard range. The defined quality parameters can, for example, at least include particle size distribution and/or starch damage and/or protein quality and/or water content. The monitored batch process parameters can, for example, at least include yield and/or energy intake/consumption and/or throughput/machine running time.

In a further embodiment variant, continuous long-term changes in the monitored batch process parameters are recorded by the regulation and control device during the grinding process when an anomaly is detected, wherein the defined deviation of the monitored operational process parameters from the generated operational process parameters of the new operational process recipe is determined as a function of the measured continuous long-term changes.

In another embodiment variant, the monitored batch process parameters are transmitted from a plurality of regulation and control devices via a network to a central monitoring unit, wherein the plurality of regulation and control devices are monitored and regulated centrally.

In yet another embodiment variant, the defined deviation of the monitored operational process parameters from the generated operational process parameters of the new operational process recipe is determined as a function of the natural fluctuations within definable $x^2$ standard deviations.

At this point it should be noted that the present invention relates not only to the device according to the invention but also to a method for realising the device according to the invention.

DETAILED DESCRIPTION OF THE INVENTION

Embodiment variants of the present invention are described below using examples. The examples of the embodiments are illustrated by the following attached figures:

FIG. 1 schematically illustrates a representation of an embodiment variant according to the invention, in which the currents are viewed from all roller mills (B(2: 21, . . . , 23)/C(3: 31, . . . , 33)), divided into B passage (here: fluted rollers 21, . . . , 23) and C passage (here: smooth rollers 31, . . . , 33). For each recipe and device setting/characteristic, there is a typical pattern that determines the quality 61 of the final product as a function of the raw material and the previous process steps (such as particle size distribution 611, starch damage 612, protein quality 613, water content 614) and the specific flour yield 62. The typical pattern can also be represented by a specific, typical colour. A change in the pattern or the colour pattern of the currents is detected as an anomaly and a corresponding electronic signal is generated to generate a warning message or to activate further devices or apparatus.

Figure 2:
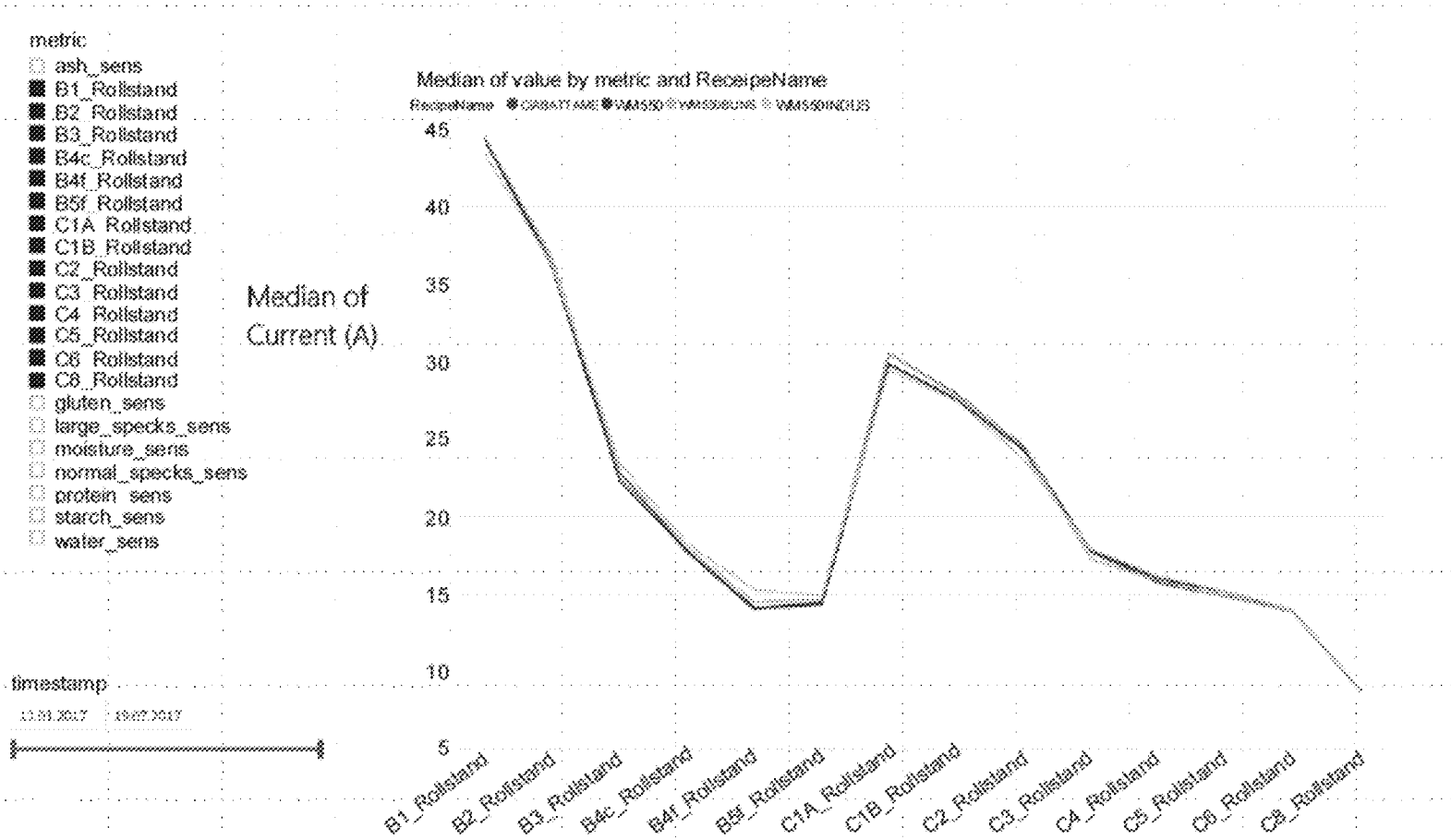

FIG. 2 schematically illustrates a representation of a typical pattern of the current of a roller mill, i.e. a typical signature of a recipe. The average value of the current for approximately 6 months of operation for the 4 recipes produced.

Figure 3:
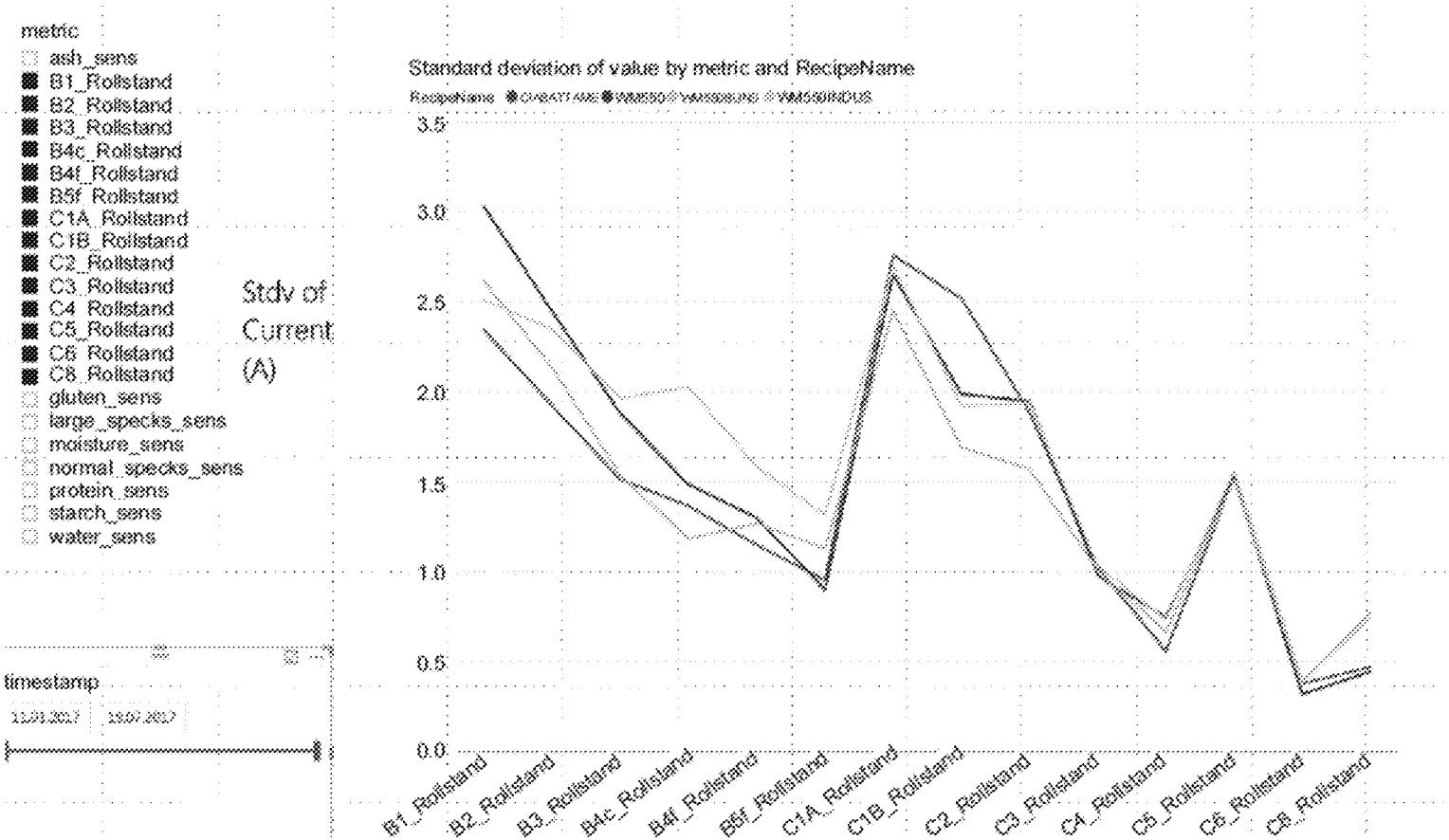

FIG. 3 shows schematically a representation of a similar pattern for the fluctuations. The standard deviation of the current for the same period and the same recipes.

Figure 4:
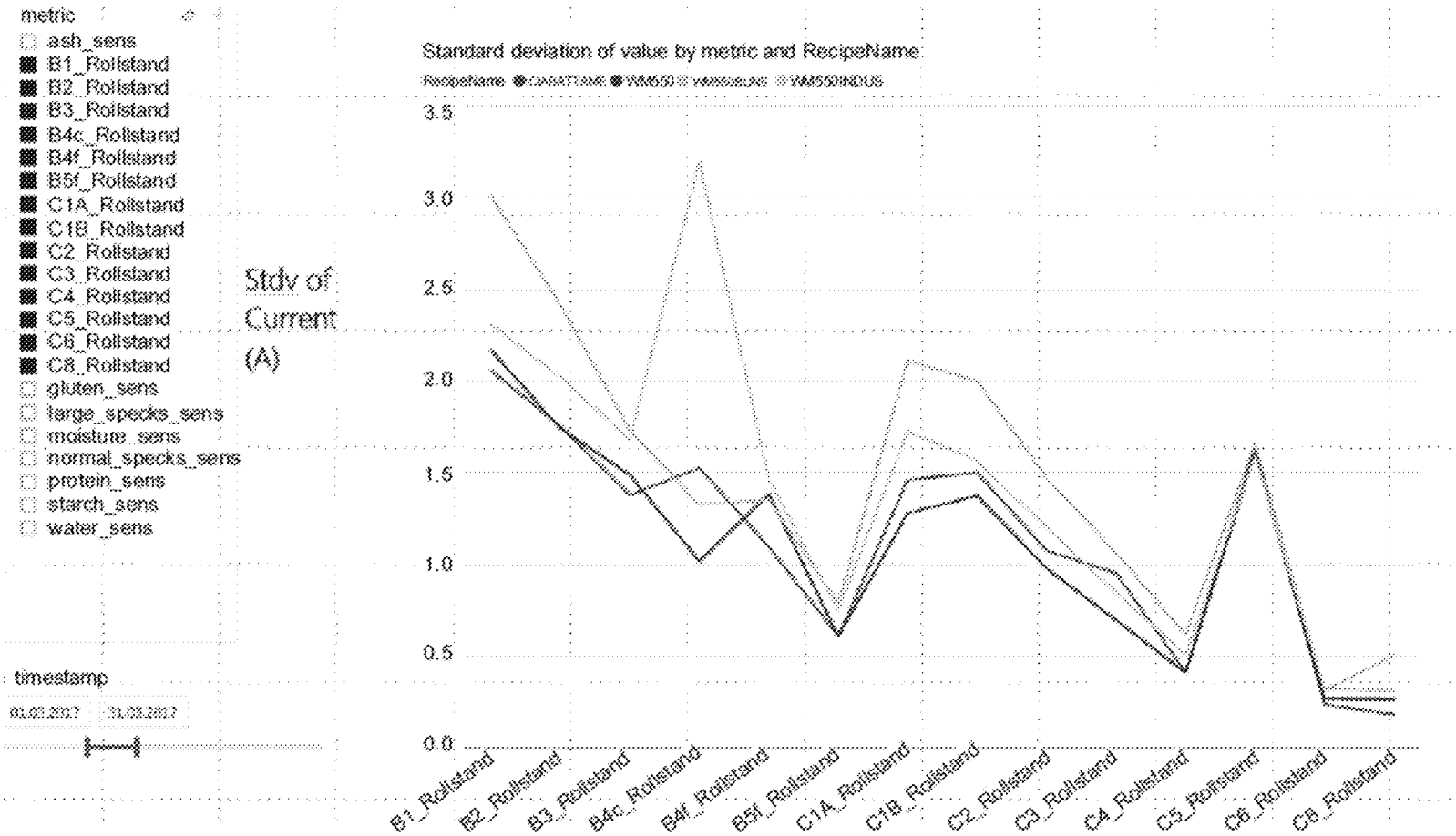
Figure 5:
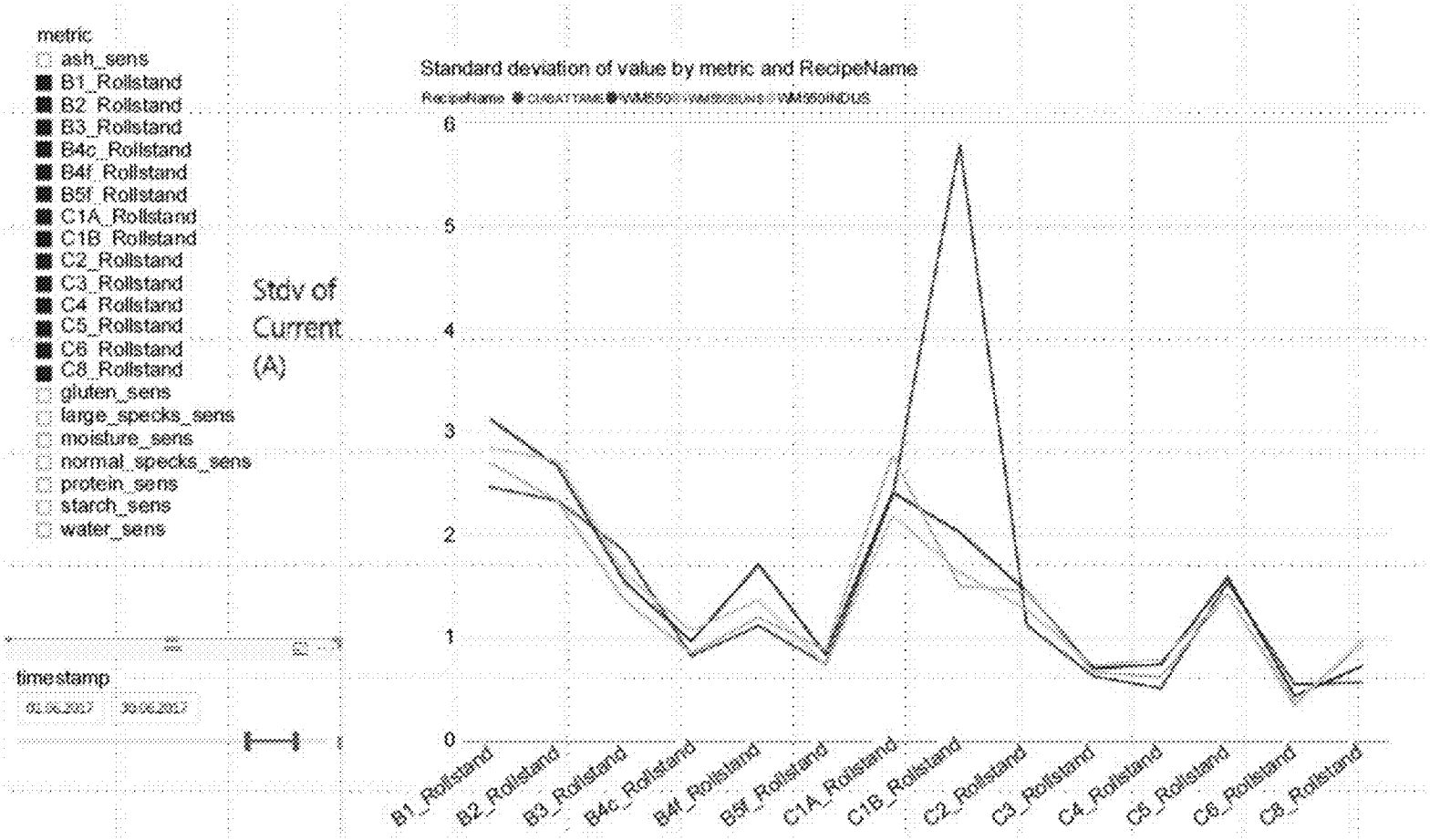

FIGS. 4 and 5 show schematically a representation of long-term trends of the signatures. The patterns change over time due to wear, seasonal or other conditional factors. FIGS. 4 and 5 show the fluctuations in the months of March (FIG. 4) and June (FIG. 5).

Figure 6:
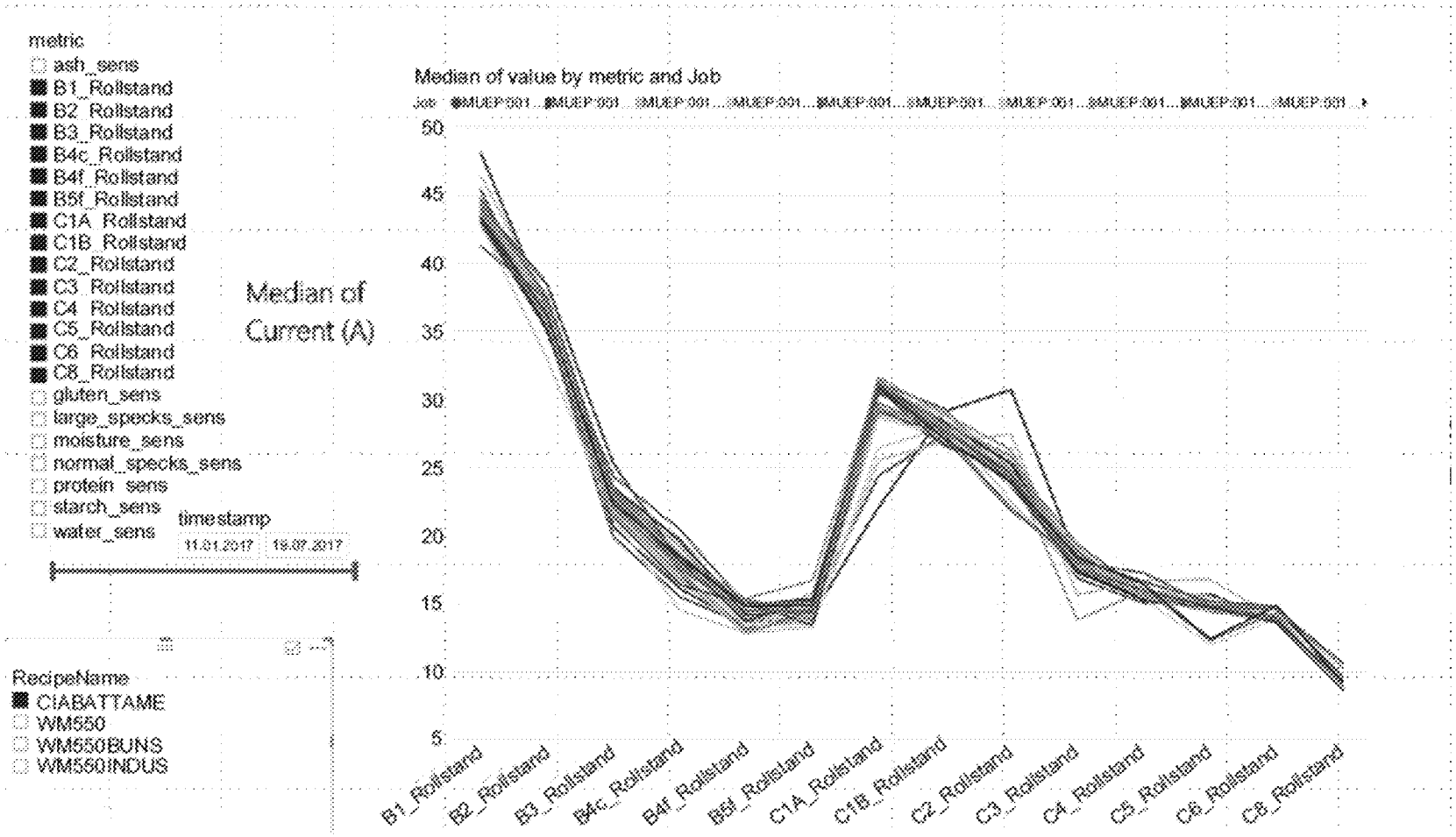
Figure 7:
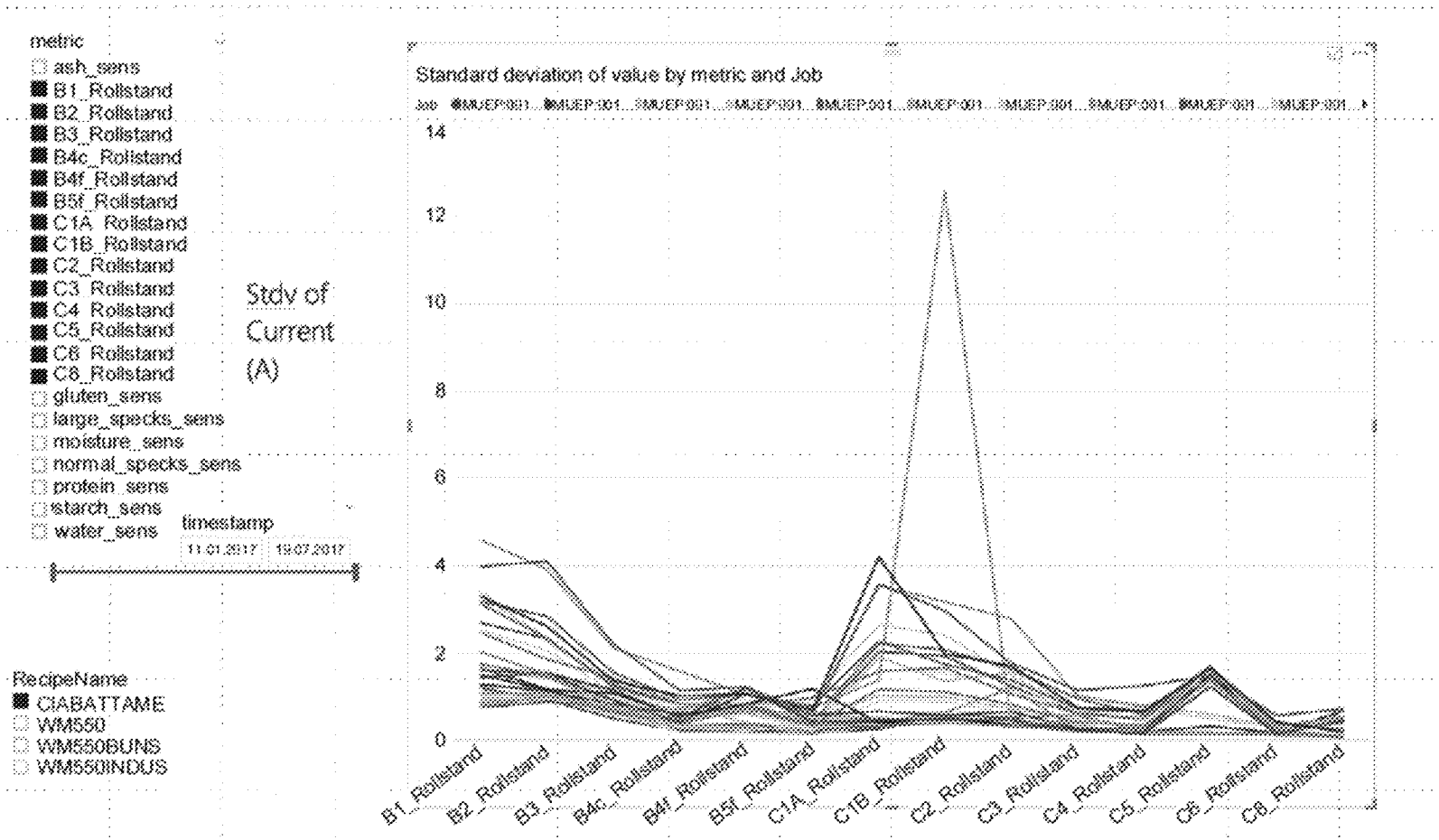
Figure 8:
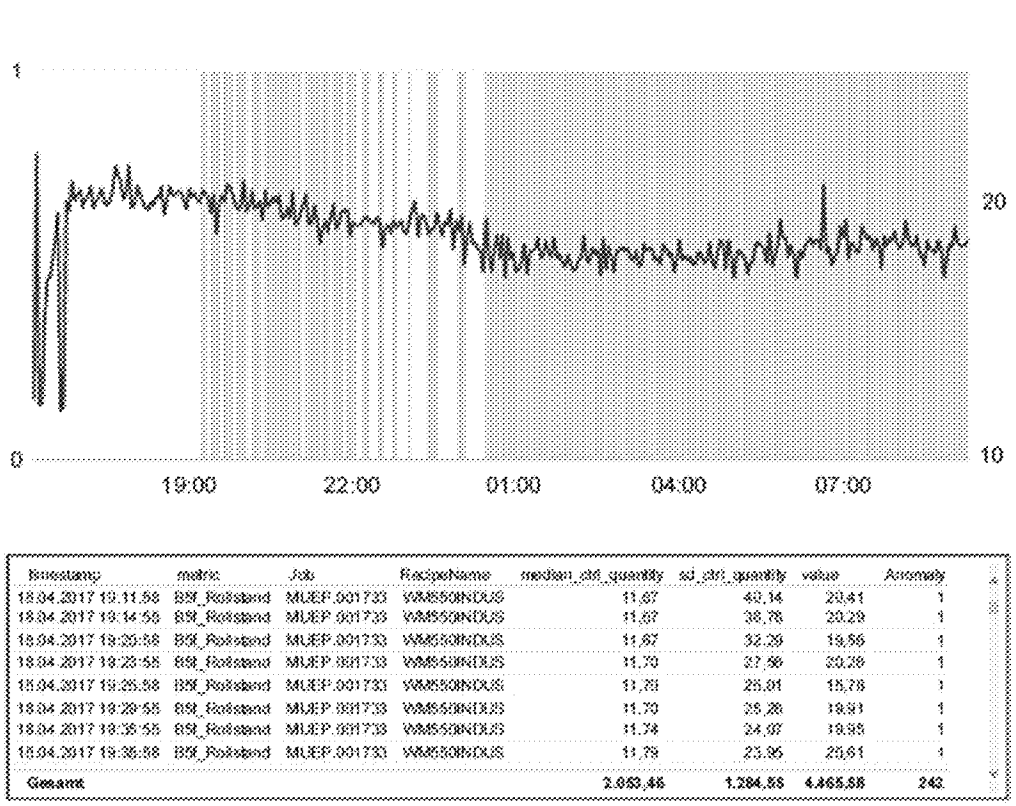
Figure 9:
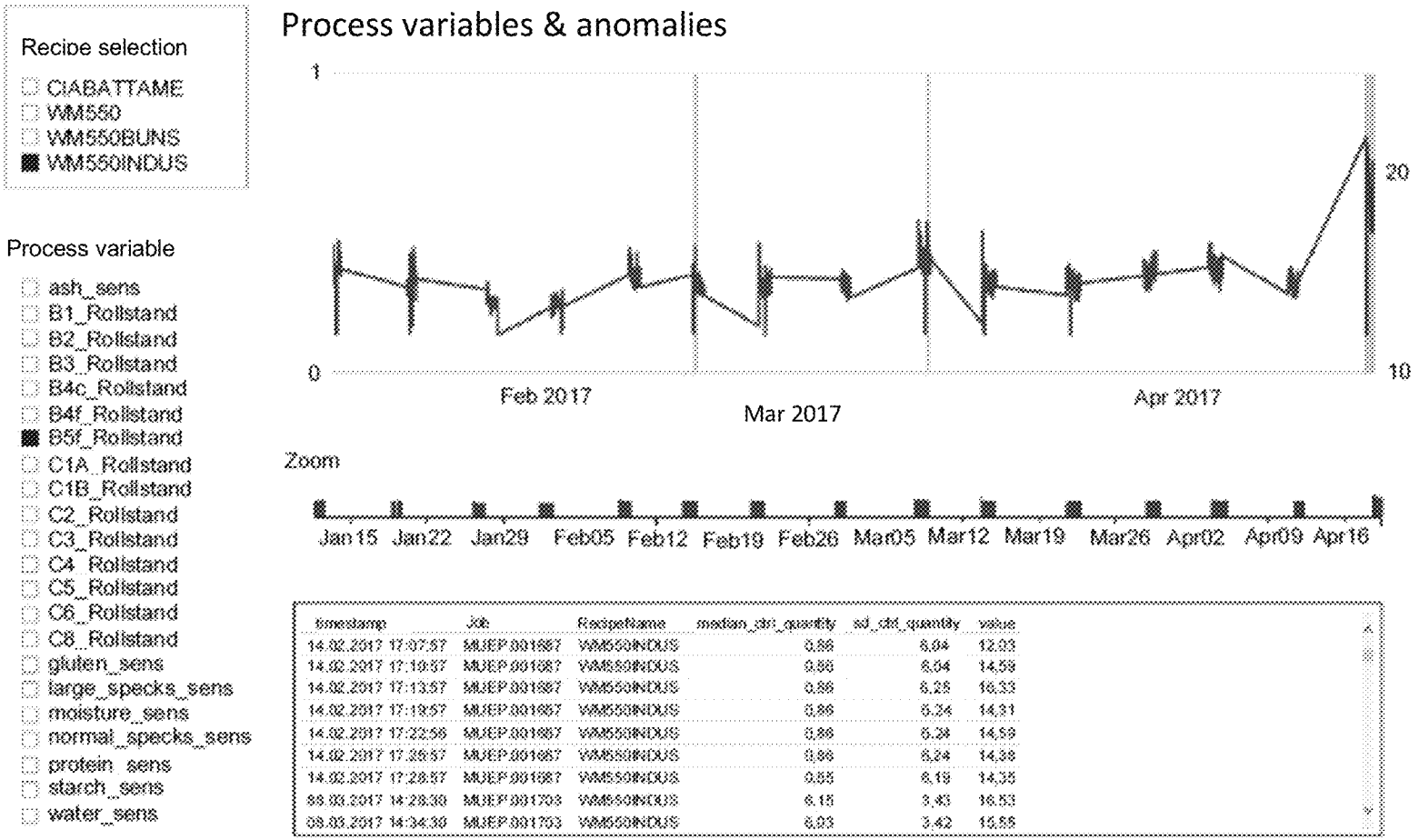
Figure 10:
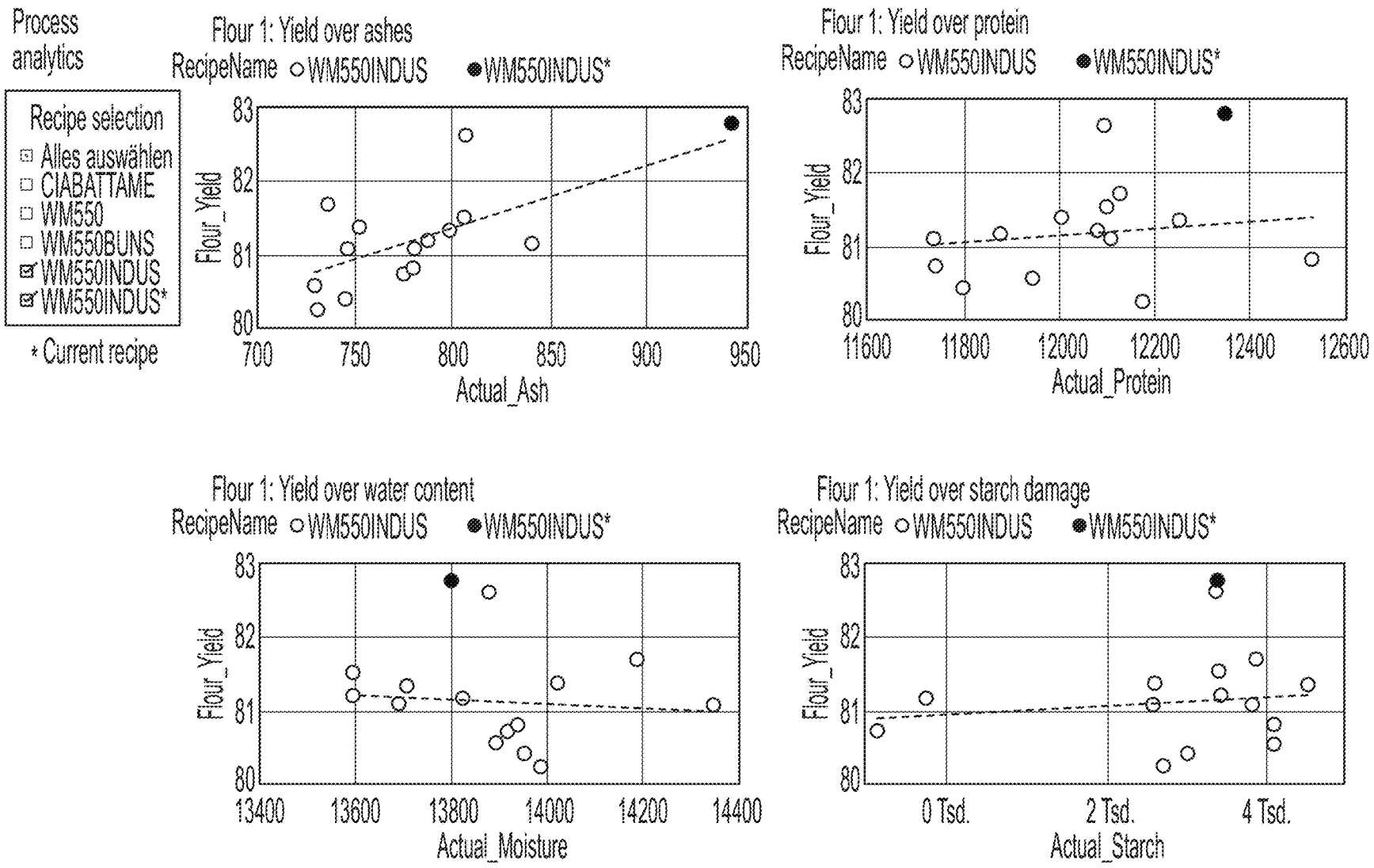

FIGS. 6 and 7 schematically show an illustration of outliers/batches with abnormal behaviour, wherein such abnormal behaviour being can be detected based on their different signature. Good/normal batches can be marked as "good" by a self-learning/machine-learning unit or operators, so that the definition of the behaviour to be expected as "normal" becomes dynamic and long-term trends can be taken into account.

Figure 11:
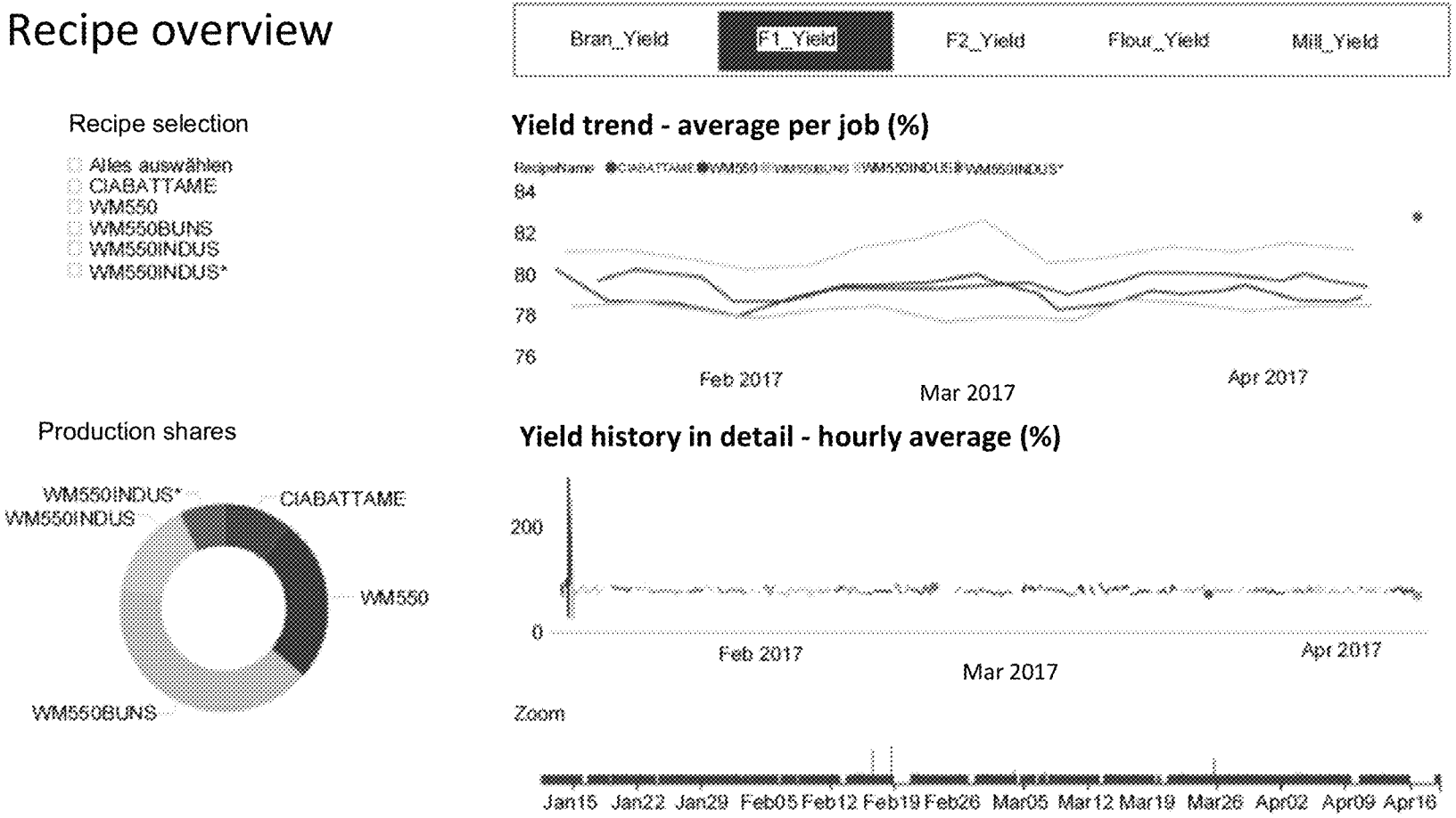

FIGS. 8-11 schematically show further representations of the detection of abnormalities as a function of process variables (FIGS. 8-9), as well as their process analysis (FIG. 10) and recipe overview (FIG. 11).

Figure 12:
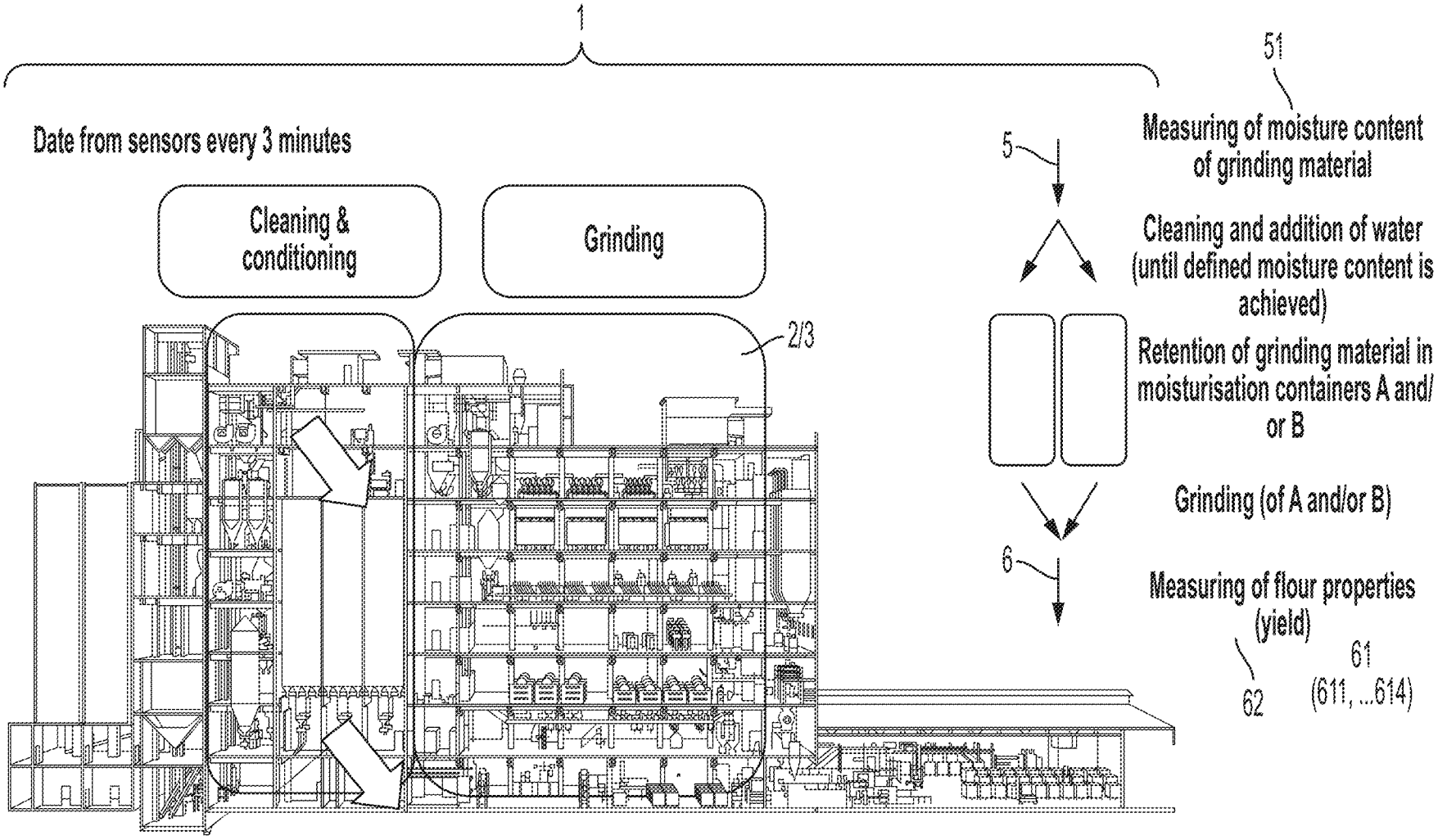

FIG. 12 shows schematically a mill installation 1, in which sensor data is measured and recorded during the process, e.g. every 3 minutes. In particular, it shows the measurement of measurement parameters 51 of the input product 5, such as the moisture content of the input product 5, and the measurement of the flour properties 61 and the yield 62 of the final product 6.

For the purposes of the present invention, "product" is understood to mean a bulk material or a mass. For the purposes of the present invention, "bulk material" means a product in powder, granule or pellet form which is used in the bulk material processing industry, i.e. in the processing of grain, grain grinding products and grain final products of the milling industry (in particular grinding of common wheat, durum wheat, rye, maize and/or barley) or speciality milling (in particular husks and/or grinding of soya, buckwheat, barley, spelt, millet/sorghum, pseudocereals and/or legumes), the manufacture of feed for farm animals and pets, fish and crustacea, the processing of oilseeds, the processing of biomass and the manufacture of energy pellets, industrial malting and malt handling plants; the processing of cocoa beans, nuts and coffee beans, the manufacture of fertilisers, in the pharmaceutical industry or in solid chemistry. For the purposes of the present invention, "mass" is understood to mean a food mass, such as a chocolate mass or a sugar mass, or a printing ink, a coating, an electronic material or a chemical, in particular a fine chemical. For the purposes of the present invention, "processing a product" means the following: (i) the grinding, comminution and/or flaking of bulk material, in particular grain, grain grinding products and grain final products of the milling industry or speciality milling industry, as stated above, for which purpose the pairs of grinding rollers or flaking rollers described in more detail below can be used as a pair of rollers; (ii) the refinement of masses, in particular food masses such as chocolate masses or sugar masses, for which pairs of fine rollers can be used, for example; and (iii) wet grinding and/or dispersing, in particular of printing inks, coatings, electronic materials or chemicals, in particular fine chemicals.

Grinding rollers within the meaning of the present invention are designed to grind granular ground material, which is usually carried out between a pair of grinding rollers by two grinding rollers. Grinding rollers, in particular the grinding rollers of the pair of grinding rollers according to the invention, usually have a substantially inelastic surface (in particular on their peripheral surface) which, for this purpose, can contain or consist of metal, for example steel, in particular stainless steel. There is usually a relatively firm and often hydraulically regulated grinding gap between the grinding rollers of the pair of grinding rollers. In many grinding installations, the grinding material is guided substantially vertically downwards through such a grinding gap. In addition, in many grinding installations, the grinding material is fed to the grinding rollers of a pair of grinding rollers by means of their gravity, wherein this supply can optionally be supported pneumatically. The grinding material is usually granular and moves as a fluid flow through the grinding gap. These properties distinguish a grinding roller and a grinding installation containing at least one such grinding roller, for example, from other rollers used in technology, which, for example, can be used to transport paper.

At least one roller, in particular two rollers of a pair of grinding rollers of a grinding installation can be designed, for example, as a smooth roller or as a fluted roller or as a roller base body with screwed-on plates. Smooth rollers can be cylindrical or cambered. Fluted rollers can have different fluted geometries, e.g. roof-shaped or trapezoidal fluted geometries, and/or have segments attached to the peripheral surface. At least one roller, in particular both rollers of the pair of grinding rollers, in particular at least one grinding roller, in particular both grinding rollers of the pair of grinding rollers, can have a length in the range from 500 mm to 2000 mm and a diameter in the range from 250 mm to 300 mm. The peripheral surface of the roller, in particular the grinding roller, is preferably non-detachably connected to the roller body and in particular is formed integrally therewith. This allows a simple manufacture and reliable and robust processing, in particular grinding, of the product. The rollers can be designed with at least one sensor for recording measured values which characterise a state of at least one of the rollers, in particular both rollers of the pair of rollers. In particular, this can be a condition of a peripheral surface of at least one of the rollers, in particular both rollers of the pair of rollers. The state can be, for example, a temperature, a pressure, a force (force component(s) in one or more directions), wear, a vibration, a deformation (expansion and/or deflection path), a rotational speed, a rotational acceleration, an ambient humidity, a position or orientation of at least one of the rollers, in particular both rollers of the pair of rollers. The sensors can be designed, for example, as a MEMS sensor (MEMS: Micro-Electro-Mechanical System). The sensor is preferably in data connection with at least one data sensor, wherein the data transmitter is designed for the contactless transmission of the measured values of the at least one sensor to a data receiver. With the aid of the at least one data transmitter, the measured values can be transmitted contactlessly to a data receiver which is not part of the roller. The grinding installation can comprise further sensors and measuring units for detecting process or product or operating parameters, in particular measuring devices for measuring the current/power intake of one or more rollers. Among other things, the sensors can be (i) at least one temperature sensor, but preferably a plurality of temperature sensors for measuring the roller temperature or a temperature profile along a roller; (ii) one or a plurality of pressure sensors; (iii) one or a plurality of force sensors (for determining the force component(s) in one or a plurality of directions); one or a plurality of wear sensors; (iv) one or a plurality of vibration sensors, in particular for determining a winding, that is to say that the processed product adheres to the peripheral surface of the roller, which hinders processing, in particular grinding, at this position; (v) one or a plurality of deformation sensors (for determining an expansion and/or a deflection path); (vi) one or a plurality of rotational speed sensors, in particular for determining a standstill of the roller; (vii) one or a plurality of rotational acceleration sensors; (viii) one or a plurality of sensors for determining an ambient humidity, which is preferably arranged on an end face of the roller; (ix) one or a plurality of gyroscopic sensors for determining the position and/or orientation of the roller, in particular for determining the width of a gap between the two rollers of the pair of rollers, which is dependent on the position and/or orientation, and the parallelism of the rollers; and/or (x) one or a plurality of sensors for determining the width of a gap between the two rolls of the pair of rollers, in particular a grinding gap between the two grinding rolls of the pair of grinding rollers, for example a sensor disposed in an end face of the roller, in particular a MEMS sensor. Any combination of these is also possible. For example, a roller can contain a plurality of temperature sensors and deformation sensors. It is also possible and within the scope of the invention that all sensors are of the same type, that is to say, for example, they are designed as measuring units for measuring the power intake of one or a plurality of rollers.

Here and below, wear is understood to mean the mechanical wear of the peripheral surface of the roller, in particular the grinding roller. In the prior art, such wear can be determined, for example, by a change in resistance caused by material removal on the peripheral surface. Alternatively or additionally, wear can be determined via a changed pressure and/or via a changed path length and/or via a changed electrical capacitance. If a unit contains only a single data transmitter, this unit can comprise at least one multiplexer which is disposed and designed for the alternate transmission of the measured values detected by the sensors to the data transmitter. The contactless transmission can take place, for example, by infrared radiation, by light pulses, by radio frequency signals, by inductive coupling or by any combination thereof. The contactless transmission of the measured values here and below always also includes the transmission of data which are obtained by appropriate processing of the measured values and which are therefore based on the measured values. For example, a unit with sensors can contain at least one signal converter, in particular at least one A/D converter, for converting the measured values detected by the at least one sensor. At least one signal converter can be assigned to each sensor, which converts the measured values detected by this sensor. The converted signals can then be fed to a multiplexer as already described above. If the signal converter is an A/D converter, the multiplexer can be a digital multiplexer. In a second possible variant, the signal converter can also be disposed between a multiplexer as described above and the data transmitter. In this case the multiplexer can be an analog multiplexer. A unit with sensors can comprise at least one printed circuit board (in particular a MEMS printed circuit board) on which one or a plurality of its sensors and/or at least one multiplexer and/or at least one signal converter and/or the at least one data transmitter and/or at least one energy receiver and/or at least one energy generator are disposed. The printed circuit board can contain measuring lines via which the sensors are connected to the multiplexer. Such a printed circuit board has the advantage that the components mentioned can be disposed on it in a very compact manner and that the printed circuit board can be manufactured as a separate assembly and, at least in some exemplary embodiments, can be replaced again if necessary. As an alternative to a printed circuit board, the sensors can also be connected to the data transmitter and/or the multiplexer via a cable harness. One or a plurality of the rollers of the grinding installation can contain at least one data memory, in particular an RFID chip. An individual identification of the roller, in particular, can be stored or is storable in this data memory, for example. Alternatively or additionally, at least one property of the roller, such as at least one of its dimensions and/or its camber, can be stored or is storable in the data memory. The data stored in the data memory are preferably also contactlessly transmitted. For this purpose, the roller can have a data transmitter. It is conceivable that the data of the data memory are transmitted by means of the same data transmitter, by means of which the measured values of the at least one sensor are transmitted according to the invention. Measuring devices with sensors can also contain a data processor integrated therein, in particular a microprocessor, an FPGA, a PLC processor or a RISC processor. This data processor can, for example, further process the measured values detected by the at least one sensor and then optionally transmit them to the data transmitter. In particular, the data processor can take over the function of the multiplexer and/or the signal converter described above in whole or in part. The microprocessor can be part of the printed circuit board also described above. Alternatively or additionally, the microprocessor can also perform at least one of the following functions: Communication with at least one data bus system (in particular management of IP addresses); printed circuit board memory management; control of energy management systems, in particular as described below; management and/or storage of identification features of the roller(s), such as geometric data and roller history; management of interface protocols; wireless functionalities. Furthermore, the measuring device, in particular the printed circuit board, can have an energy management system which can carry out one, a plurality or all of the following functions: (i) regular, in particular periodic, transmission of the measured values from the data transmitter; (ii) transmission of the measured values from the data transmitter only if a predetermined condition is met, in particular if a warning criterion described below is met; (iii) regular, in particular periodic, charging and discharging of a capacitor or an energy store. A grinding/product processing installation for processing a product, in particular the grinding installation for grinding ground material, contains at least one roller or pair of rollers, in particular one pair of grinding rollers. A gap is formed between the rollers of the pair of rollers. In particular, a grinding gap is formed between the grinding rollers of a pair of grinding rollers. In particular when grinding grinding material, the grinding material can be guided substantially vertically downwards through such a grinding gap. In addition, especially when grinding grinding material, this grinding material is preferably fed to the grinding rollers by means of its gravity, which can optionally be supported pneumatically. The product, in particular the bulk material, in particular the grinding material, can be granular and move as a fluid flow through the grinding gap. In particular, in the case of refining masses such as chocolate masses or sugar masses, this mass can alternatively also be guided from bottom to top through the gap formed between the rollers.

The invention relates, for example, to product processing installations, in particular grinding installations for grinding grinding material. The product processing installation contains at least one roller or pair of rollers. In addition, the product processing installation can have at least one, in particular stationary, data receiver for receiving the measured values transmitted by the data transmitter of at least one of the rollers or pairs of rollers. The grinding system can be, for example, a single roller mill of a grain mill or an entire grain mill with at least one roller mill, wherein at least one roller mill contains at least one grinding roller as described above. However, the product processing installation can also be designed as (i) a flaking roll mill for flaking bulk material, in particular grain, grain milling products and grain final products from the milling industry or speciality milling industry, as stated above, (ii) a roller mill or a roll mill for the production of chocolate, in particular a roughing mill with, for example, two or five rollers, in particular two or five fine rollers, or an end fine roller mill, (iii) a roll mill for wet grinding and/or dispersing, for example printing inks, coatings, electronic materials or chemicals, in particular fine chemicals, in particular a three roller mill. The invention relates in particular to a method for operating a product processing installation as described above, in particular a grinding installation as described above. The method comprises a step in which, with the data receiver of the product processing installation, measured values are received by a data transmitter of at least one of the rollers or pairs of rollers. The data received in this way are then processed further. For this purpose, they can be fed to a control unit of the product processing installation, in particular the grinding installation, from where they can be passed on to an optional higher-level guidance system. With the help of the control unit and/or the guidance system, the entire product processing installation, in particular the entire grinding installation, or a part thereof can be controlled and/or regulated.

A warning message, for example, is issued by the control unit or an electrical alarm signal is generated if a predefined warning criterion is met. The warning criterion can consist, for example, in that the measured value of at least one of the sensors exceeds a limit value predetermined for this sensor. In another variant, the warning criterion can consist in that the difference between the largest measured value and the smallest measured value, which are measured by a predetermined quantity of sensors, exceeds a predetermined limit value. If the warning criterion is met, a warning signal can be output (for example optically and/or acoustically) and/or the product processing installation can be brought to a standstill (for example by the control unit). In addition, the control unit can visualise the measured values acquired by the at least one sensor or data obtained therefrom. The product processing installation can contain a device for measuring particle sizes and their distributions downstream from a pair of rollers in terms of product flow. As a result, the measurement of the particle sizes and their distributions can be combined, for example, with a measurement of the state of wear and/or the roller contact pressure. This is particularly advantageous if the roller, in particular the grinding roller, is a fluted roller. As an alternative or in addition, a device for NIR measurement of the product flow, in particular of the grinding material flow, can also be disposed downstream of a roller, in particular a grinding roller. This is particularly advantageous if the rollers, in particular the grinding rollers, are smooth rollers. Due to the detection of the state of wear, both variants enable early planning of maintenance.

With the product processing installation according to the invention, it is possible to objectively monitor the power intake of grinding rollers (individually or as a pair) continuously during the grinding process, for example of a product batch. Additional parameters can be measured and monitored. For example, the roller temperature or the interior temperature of the housing of the roller mill and/or the room temperature, i.e. the outside temperature, can also be included in the monitoring, since these temperature values have an influence on the temperature of the grinding rollers etc. The higher the contact pressure, the greater the energy requirement, i.e. the kilowatt consumption. With a higher contact pressure, more comminution energy is generated, which is partly released as heat to the product to be comminuted and also to the roller material. This means that the temperature inside the roller mill or a similar machine also increases. If the product curtain is even, the grinding work can be optimised with the help of the temperature that is set on the surface of the roller and recorded with temperature probes by changing an optimal temperature assigned to the product to be processed with the help of the contact pressure and/or the grinding gap adjustment. This change can take place both manually and fully automatically with the aid of a computer and/or a control, for example an SPC control (self-programmable control) or also PLC control (programmable logic control) (regulating device). The further monitored parameters can be assigned physical, technological or process-related limits assigned as necessary boundary conditions to be adhered to. The additional monitoring of such boundary conditions can lead to an improvement in the control behaviour and to a better product quality of the final products.

According to the invention, the grinding installation 1 is regulated by an intelligent, self-adaptive regulation and control device 4 with self-optimised control of the mill installation 1 and the grinding line of a roller system of the mill installation 1. The grinding line comprises a plurality of processing units 2(B)/3(C), which, based on operational process parameters 411*l*, . . . , 411*x*, can each individually be controlled and individually regulated in their operation by means of the regulation and control device 4. A batch control with a defined processing sequence in the processing units 2(B)/3(C) can be regulated by means of an operational process recipe 411, wherein a defined quantity of a final product 6 is produced from one or a plurality of starting materials 5 with the measurement parameters 51 by means of the operational process recipe 411 with the measurement parameters 61 (611, . . . , 61*x*) and the yield 62. The processing units 2(B)/3(C) are controlled based on specific operational batch process parameters assigned to the operational process recipe. The regulation and control device 4 comprises a pattern recognition module for detecting operational process recipes 41 with multi-dimensional batch process parameter patterns 411*l*, . . . , 411*x*, wherein an operational process recipe 41 comprises, stored, at least one or a plurality of starting products 5, a defined sequence of a grinding process within the processing units 2(B)/3(C) of the grinding line, and operational batch process parameters 411*l*, . . . , 411*x* assigned to the respective processing units of the grinding line. The regulation and control device 4 comprises a storage device 43 for storing historical operational process recipes 431 with historical batch process parameters 431*l*, . . . , 431*x*, wherein the historical batch process parameters 431*l*, . . . , 431*x* of a process recipe 431 each define a process-typical, multi-dimensional batch process parameter pattern 432*l*, . . . , 432*x* of an optimised batch process in the standard range.

When entering final product parameters and/or input product parameters of a new operational process recipe 411, closest batch process parameter patterns 432*i* are triggered and/or selected by means of pattern recognition of the pattern recognition module of one or more of the stored historical operational process recipes 432 based on the assigned multi-dimensional batch process parameter patterns 432*l*, . . . , 432*x*. The pattern recognition module can in particular comprise a machine-based neural network structure. The identification and recognition of the pattern then takes place, for example, as part of the network training. A training based on a neural network can, for example, only be based on historical pattern 432. The regulation parameters 411 of the mill installation 1 can be regulated on the basis of the updated neural network structure and optimisation oriented in particular towards at least one predefinable target variable. By means of the regulation and control device 4, based on the triggered closest batch process parameter patterns 432*i*, new batch process parameter patterns with new batch process parameters 411*l*, . . . , 411*x* for the entered new operational process recipe 411 are generated, wherein the processing units 2(B)/3(C) based on the generated operational process recipes with the assigned batch process parameters are correspondingly controlled and regulated by means of the regulation and control device 4. During the grinding process of the new operational process recipe 411, the operational process parameters are continuously monitored by means of the regulation and control device 4, wherein in the case of detection of an anomaly as a defined deviation of the monitored operational process parameters 411*l*, . . . , 411*x* from the specified operational process parameters 411*l*, . . . , 411*x* of the new operational process recipe 411, a warning signal is transmitted to an alarm unit. The batch process parameters can, for example, comprise at least the flows of one or a plurality of roller mills 2(B)/3(C) of the mill installation 1. The one or more roller mills can, for example, comprise at least fluted rollers (B passage) and/or smooth rollers (C passage). The batch process parameters can, for example, comprise at least the flows of all roller mills 2(B)/3(C) of the mill installation 1. Defined quality parameters 61 (611, . . . , 61*x*), for example, of the final product 6 and specific flour yield 62 as a function of the starting products 5 and/or its measurement parameters 51 can be determined by means of the process-typical batch process parameters of an optimised batch process in the normal range. The defined quality parameters 61 can, for example, at least include particle size distribution 611 and/or starch damage 612 and/or protein quality 613 and/or water content 614. The monitored batch process parameters 411*l*, . . . , 411*x* can, for example, at least include yield 62 and/or energy intake/consumption and/or throughput/machine running time. Continuous long-term changes in the monitored batch process parameters can be recorded by the regulation and control device during the grinding process, for example, when an anomaly is detected, wherein the defined deviation of the monitored operational process parameters from the generated operational process parameters of the new operational process recipe is determined as a function of the measured continuous long-term changes. The monitored batch process parameters can, for example, be transmitted from a plurality of regulation and control devices 4 according to the invention via a network to a central monitoring unit, wherein the plurality of regulation and control devices 4 are monitored and regulated centrally.

Among other things, the invention has the advantage that it allows in a technically novel way the identification of long-term trends in production, the automated detection of abnormalities, the automated 24/7 (remote) monitoring and detection of the production parameters for (i) yield, (ii) energy, and (iii) throughput/machine running time, etc.

In an embodiment variant, the currents of all roller mills 2(B)/3(C) can be viewed, e.g. divided into B passage (fluted rollers) and C passage (smooth rollers). For each recipe, there is a typical pattern 421 that determines the quality 61 of the final product 6 as a function of the raw material 5 and the previous process steps (particle size distribution 611, starch damage 612, protein quality 613, water content 614) and the specific flour yield 62. A change in the pattern 421 of the currents is automatically detected as an anomaly by the system 4 and a warning message is generated.

LIST OF REFERENCE NUMERALS

1 mill installation
2 processing units (B)
  21, . . . , 23 fluted rollers
3 processing units (C)
  31, . . . , 33 smooth rollers
4 regulation and control device
  41 input parameter
    411 operational process recipe
      411*l*, . . . , 411*x* operational process parameter
    421 pattern
      412*l*, . . . , 412*x* batch parameter pattern
  42 pattern recognition module
  43 storage device
    431 historical operational process recipe
      431*l*, . . . , 431*x* historical operational process parameter
      431*i* triggered closest process parameter
    432 historical pattern
      432*l*, . . . , 432*x* batch parameter pattern
      432*i* triggered closest pattern
5 input products
  51 measuring parameter input materials
6 final products
  61 measuring parameter final products
    611 particle size distribution
    612 starch damage
    613 protein quality
    614 water content
  62 specific yield

The invention claimed is:

1. A self-adaptive regulation and control method for at least one regulation and control device comprising circuitry configured for self-optimized control of a mill installation and a grinding line of a roller system for the mill installation, wherein the grinding line comprises a plurality of processors, which, based on operational process parameters, are configured to be individually controlled by the regulation and control. device and are configured to be individually regulated in their operation, wherein by an operational process recipe, a batch control with a defined processing sequence in the processors is regulated, wherein by the operational process recipe, a defined amount of a final product is produced from one or more input products, and wherein the processors are controlled based on specific operational batch parameters assigned to the operational process recipe, the method comprising:

detecting, using a pattern recognition module implemented by the circuitry of the regulation and control device, operational process recipes with multi-dimensional batch parameter patterns, wherein an operational process recipe comprises, stored, at least one or more input product parameters and/or final product parameters, a defined sequence of a grinding process within the processors of the grinding line, and operational process parameters assigned to the respective processors of the grinding line, storing, using a storage in the regulation and control device, historical operational process recipes with historical batch process parameters, wherein the historical batch process parameters of a process recipe each define a process-typical, multi-dimensional batch process parameter pattern of an optimized batch process, triggering and/or selecting, when entering final product parameters and/or input product parameters of a new operational process recipe, closest batch process parameter patterns by pattern recognition of the pattern recognition module of one or more of the stored historical operational process recipes based on the assigned multi-dimensional batch parameter patterns as a new batch parameter pattern, generating, using the regulation and control device based on the triggered closest batch process parameter patterns, new operational process parameters for the entered new operational process recipe, wherein the processors based on the generated operational process recipe with the assigned new operational process parameters are correspondingly controlled and regulated by the regulation and control device, and continuously monitoring, during the grinding process of the new operational process recipe, the operational process parameters by the regulation and control device, wherein in the case of detection of an anomaly as a defined deviation of the monitored operational process parameter from the specified operational process parameters of the new operational process recipe, a warning signal is transmitted to an alarm circuitry.

2. The self-adaptive regulation and control method according to claim 1, wherein the operational process parameter comprises at least measuring parameters relating to the currents and/or power consumption of one or more roller mills of the mill installation and/or yield and/or throughput/machine running time.

3. The self-adaptive regulation and control method according to claim 2, wherein the roller system comprises at least fluted rollers and/or smooth rollers.

4. The self-adaptive regulation and control method according to claim 2, wherein the operational process parameter comprises at least measuring parameters relating to the currents and/or power consumption of all roller mills of the mill installation.

5. The self-adaptive regulation and control method according to claim 1, comprising determining defined quality parameters of the final product and specific flour yield as a function of the input products by the process-typical operational process parameters of the optimized batch process.

6. The self-adaptive regulation and control method according to claim 5, wherein the defined quality parameters comprise at least particle size distribution and/or starch damage and/or protein quality and/or water content.

7. The self-adaptive regulation and control method according to claim 1, wherein the monitored operational process parameters comprise at least yield and/or energy intake/consumption and/or throughput/machine running time.

8. The self-adaptive regulation and control method according to claim 1, comprising:

detecting, during the grinding process, in the case of detection of the anomaly, continuous long-term changes in the monitored operational process parameters by the regulation and control device, and determining the defined deviation of the monitored operational process parameter from the generated operational process parameter of the new operational process recipe as a function of the measured continuous long-term changes.

9. The self-adaptive regulation and control method according to claim 1, comprising:

transmitting the monitored operational process parameters of a plurality of regulation and control devices via a network to a central monitoring circuitry, and centrally monitoring and regulating the plurality of regulation and control devices.

10. The self-adaptive regulation and control method according to claim 1, comprising determining the defined deviation of the monitored operational process parameters from the generated operational process parameters of the new operational process recipe as a function of the natural fluctuations within definable $x^2$ standard deviations.

11. A self-adaptive regulation and control device for the automated control and self-optimization of a mill installation or a grinding line of a roller system, wherein the grinding line comprises a plurality of processors, which, based on operational process parameters, are configured to be individually controlled and individually regulated in their operation by the regulation and control device, wherein by a batch control, a defined amount of a final product is produced from one or more input products according to a defined sequence of the processors based on specific assigned operational process parameters, the self-adaptive regulation and control device comprising:

circuitry configured to implement a pattern recognition module for detecting operational process recipes with multi-dimensional batch parameter patterns, wherein an operational process recipe comprises, stored, at least one or more input product parameters and/or final product parameters, a defined sequence of a grinding process within the processors of the grinding line, and operational process parameters assigned to the respective processors of the grinding line, store, using a storage in the regulation and control device, historical operational process recipes with historical batch process parameters, wherein the historical operational process parameters of an operational process recipe each define a process-typical, multi-dimensional batch process parameter pattern of an optimized batch process, trigger and/or select, when entering final product parameters and/or input product parameters of a new operational process recipe, closest batch process parameter patterns by pattern recognition of the pattern recognition module of one or more of the stored historical operational process recipes based on the assigned multi-dimensional batch parameter patterns as a new batch parameter pattern, generate, based on the triggered closest batch parameter pattern, new operational process parameters for the entered new operational process recipe, wherein the processors based on the determined operational process recipe and the operational process parameters are correspondingly controlled and regulated by the regulation and control device, and continuously monitor, during the grinding process, the operational process parameters, wherein in the case of detection of an anomaly as a defined deviation of the monitored operational process parameters from the determined operational process parameters of the new operational process recipe, the circuitry is configured to transmit a warning signal to an alarm circuitry.

* * * * *